US005865551A

United States Patent [19]

Lalli et al.

[11] Patent Number: 5,865,551

[45] Date of Patent: Feb. 2, 1999

[54] CLEANING DEVICE WITH REPLACEABLE CLEANING FLUID RESERVOIR

[75] Inventors: Anthony Lalli, Medford, N.J.; Cosmo D. Bertino, III, Norristown, Pa.

[73] Assignee: New Knight Inc., Paoli, Pa.

[21] Appl. No.: 661,209

[22] Filed: Jun. 10, 1996

[51] Int. Cl.[6] ..... B05C 17/00; A47L 13/22

[52] U.S. Cl. ..... 401/139; 401/138; 401/156; 401/190; 15/119.2

[58] Field of Search ..... 401/152, 156, 401/157, 138, 139, 190; 15/119.2

[56] References Cited

U.S. PATENT DOCUMENTS

| | | | |
|---|---|---|---|
| 1,618,930 | 4/1927 | Istrico . | |
| 2,053,282 | 9/1936 | Gewalt . | |
| 2,566,429 | 9/1951 | Schulman . | |
| 3,094,152 | 6/1963 | Kenny et al. . | |
| 3,102,292 | 9/1963 | Jepson et al. . | |
| 3,123,851 | 3/1964 | Arndt et al. . | |
| 3,254,804 | 6/1966 | Grant . | |
| 3,256,893 | 6/1966 | McEachran | 401/190 |
| 3,457,016 | 7/1969 | Gotberg . | |
| 3,490,657 | 1/1970 | Williams et al. | 401/190 |
| 3,600,100 | 8/1971 | Arones . | |
| 4,432,472 | 2/1984 | Lamm . | |
| 4,534,669 | 8/1985 | Heck et al. | 401/157 X |
| 4,572,691 | 2/1986 | Kirchhoff | 401/157 X |
| 4,802,782 | 2/1989 | Scalf . | |
| 4,886,191 | 12/1989 | Yoshitomi . | |
| 5,092,699 | 3/1992 | Silvenis . | |
| 5,098,291 | 3/1992 | Curtis et al. | 401/190 X |

FOREIGN PATENT DOCUMENTS

| | | | |
|---|---|---|---|
| 2639062 | 3/1978 | Germany | 401/156 |

*Primary Examiner*—Steven A. Bratlie
*Attorney, Agent, or Firm*—Dann, Dorfman, Herrell & Skillman, P.C.

[57] ABSTRACT

A cleaning device includes a cleaning head, such as a mop, for cleaning surfaces. The device includes an elastically expandable reservoir for storing cleaning fluid. The reservoir is enclosed within a replaceable cartridge fitting within the handle of the cleaning device. The cleaning fluid flows from the reservoir to a discharge nozzle and onto the surface to be cleaned. A fluid controller is also provided to control the flow of fluid from the cartridge.

15 Claims, 6 Drawing Sheets

CLEANING DEVICE WITH REPLACEABLE CLEANING FLUID RESERVOIR

FIELD OF THE INVENTION

The present invention relates to cleaning devices and more particularly to cleaning devices that include a cleaning head and a reservoir for storing cleaning fluid that is discharged onto a surface to be cleaned by the cleaning head.

BACKGROUND OF THE INVENTION

In many situations, it is desirable to have a cleaning device that incorporates a cleaning head and a reservoir for storing cleaning fluid. With such a device, cleaning fluid can be dispensed onto the surface to be cleaned, and then the cleaning head can be used with the cleaning fluid to clean the surface. Although cleaning devices that combine a cleaning head with a cleaning fluid reservoir are well known, the known devices suffer from at least one of several drawbacks.

Devices such as the devices disclosed in U.S. Pat. No. 4,802,782 to Scalf, and U.S. Pat. No. 2,566,429 to Schulman, utilize gravity feed to discharge the cleaning fluid from a reservoir to a surface to be cleaned. However, gravity feed does not operate properly unless the reservoir is maintained above the cleaning surface. Therefore, when vertical or overhead surfaces are to be cleaned, gravity-fed devices do not operate to properly discharge the cleaning fluid onto the cleaning surface. Additionally, gravity-fed devices lack sufficient fluid pressure to provide a proper spray pattern to disperse the cleaning fluid onto the cleaning surface.

Other known devices pressurize the fluid in the reservoir to overcome the problems associated with gravity-fed devices. However, such devices are either overly bulky and heavy, or are cumbersome to operate. For instance, the device disclosed in U.S. Pat. No. 2,053,282 to W. C. Gewalt utilizes a pressure vessel as a cleaning fluid reservoir. The reservoir is pressurized by way of a hand pump. Operation of the device in Gewalt '282 is burdened by the need to operate the hand pump to pressurize the reservoir. Additionally, the pressure vessel adds bulk and weight to the device, making the device more difficult to use, particularly on vertical or overhead surfaces.

SUMMARY OF THE INVENTION

With the foregoing in mind, the present invention provides a novel cleaning device that includes a replaceable elastic reservoir for storing cleaning fluid. In this way, the cleaning fluid in the reservoir can be stored under positive pressure without the added weight of a pressure vessel and the burden of pressurizing the reservoir before operation.

In accordance with the present invention, a cleaning device that includes a reservoir for storing cleaning fluid is provided. The cleaning device includes a cleaning head connected to an elongated handle. An elastically-expandable reservoir is provided for storing cleaning fluid. A fluid controller connected to the reservoir controls the flow of fluid from the reservoir.

The apparatus in accordance with the present invention also provides a fluid supply cartridge that is operable to supply cleaning fluid to a cleaning device that has a cleaning head connected to an elongated handle, an orifice for discharging cleaning fluid and a fluid controller connected to the orifice. The fluid supply cartridge includes an outer shell and an elastically-expandable reservoir within the shell. The elastically-expandable reservoir receives and stores cleaning fluid under positive pressure.

BRIEF DESCRIPTION OF THE DRAWINGS

All of the objectives of the present invention are more fully set forth hereinafter with reference to the accompanying drawings, wherein.

DETAILED DESCRIPTION OF PREFERRED EMBODIMENTS

Figure 1:
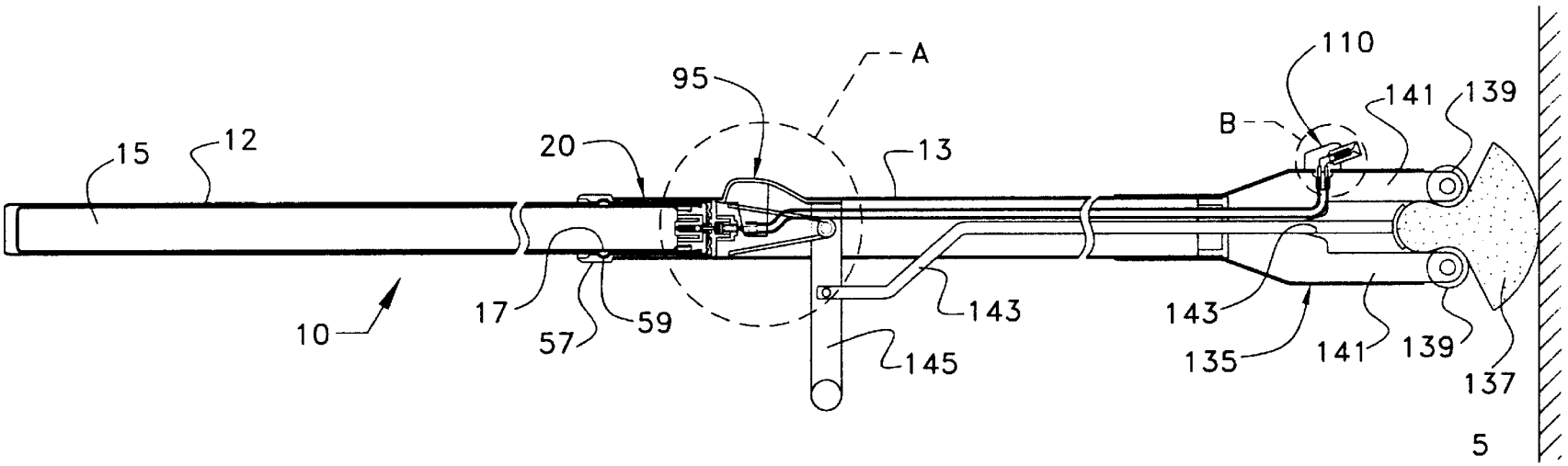
FIG. 1 is a longitudinal part sectional foreshortened view of a cleaning device with a replaceable cleaning fluid reservoir.
Figure 2:
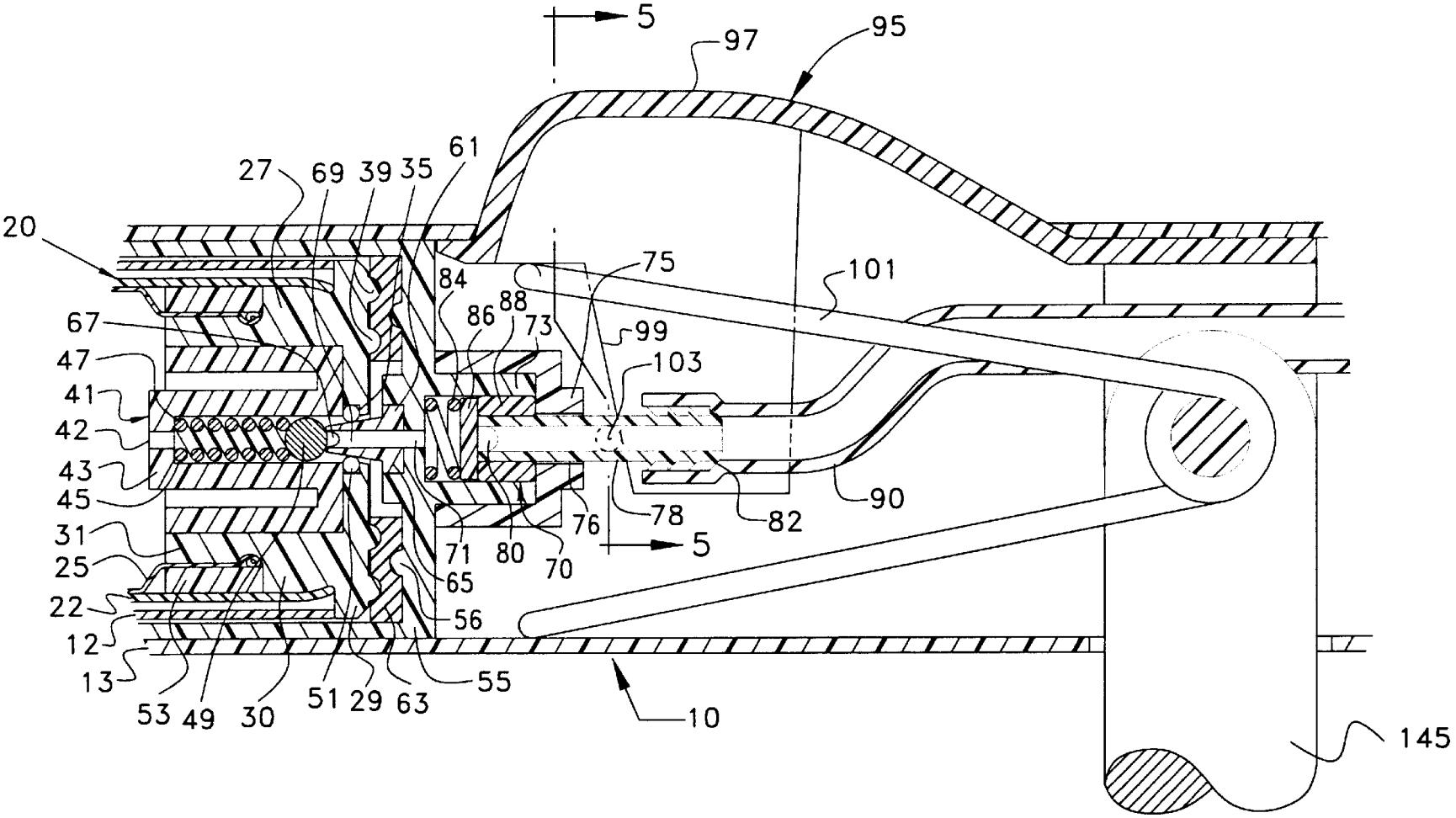
FIG. 2 is an enlarged fragmentary longitudinal sectional view of the portion of the device encircled at A in FIG. 1, illustrating the control valve in the closed position.

Referring now to the figures in general and FIGS. 1–2 specifically, a cleaning device with a replaceable cleaning fluid reservoir 10 is shown. The cleaning device 10 has a two-part handle, comprising an upper handle 12 and a lower handle 13. A cleaning head 135 is attached to a distal end of the lower handle 13. A replaceable cartridge 20 fits within the upper handle 12. The cartridge 20 includes an elastically-expandable reservoir 25 that contains cleaning fluid 15. When the cartridge 20 is inserted into the upper handle 12, and the upper handle is connected to the lower handle 13, the cartridge fits within a cartridge socket 55 in the lower handle. The cartridge 20 has a reservoir 25 for containing cleaning fluid. The reservoir is closed by a cap 27 having an opening 35 which registers with a control valve 70 mounted centrally in the lower handle 13 beyond the socket 55. The control valve 70 controls the flow of cleaning fluid from the cartridge 20 to a spray head 110 that is connected to the cleaning head 135. The control valve 70 is actuated by an actuator 95 projecting externally from the lower handle. By depressing the actuator 95, fluid flows from the cartridge 20 through a tube 90 to the spray head 110, which sprays the fluid onto a surface that is to be cleaned 5.

Referring now to FIG. 1, the cleaning device 10 is shown on a surface to be cleaned 5. In the present instance, the cleaning device 10 utilizes a roller wringer mop as a cleaning head 135. Alternatively, it may be desirable to use one of a variety of cleaning heads, including, but not limited to, an abrasive pad, an absorbent pad, a scrub brush or a flexible wiper blade.

The roller mop 135, as shown in FIG. 1, comprises a pair of parallel spaced-apart arms 141 that straddle a sponge 137. A set of rollers 139 is rotatably mounted to the end of each of the arms 141, so that the rollers straddle the sponge 137, confronting the sponge. A linkage 143 extending through the hollow lower handle 13 connects the sponge 137 to a wringer lever 145. The linkage 143 is pivotally connected to the wringing lever 145; and the sponge 137 is releasably connectable with the linkage so that a worn or damaged sponge can be replaced. The wringer lever 145 is pivotally connected to the lower handle 13 by a pivot pin. By pivoting the wringing lever 145 away from the mop head 135, the linkage 143 draws the sponge 137 between the rollers 139, thereby wringing the sponge.

To aid in cleaning the surface 5, the device 10 provides a flow of cleaning fluid 15 that is applied to the cleaning surface 5 adjacent the mop head 135. The cleaning fluid 15 is stored in a replaceable cartridge 20. The flow of the fluid is controlled by an actuator 95 operable by the operator. The fluid flows through a tube 90 to a spray head 110, which directs the cleaning fluid onto the cleaning surface 5 adjacent the mop head 135.

The cartridge 20 stores the supply of cleaning fluid 15. As shown in more detail in FIGS. 2, 6, the cartridge 20 comprises a rigid outer shell 22 enclosing the elastic reservoir 25. The outer shell 22 is a plastic tube closed at one end, and having an opening at the other end. The reservoir 25 is an elastic bladder having an opening at one end. The reservoir is made of a resilient expandable material such as rubber. In the present instance, the reservoir is made of a length of rubber surgical tubing that is sealed at one end, for example by epoxy cement.

A cap 27 closes the openings of both the outer shell 22 and the reservoir 25. The cap 27 has three portions: a flange 29, an intermediate body portion 30, and a reduced diameter end plug 31. The body portion 30 plugs the opening of the outer shell 22; and the end plug 31 plugs the opening of the reservoir 25. The marginal end of the reservoir 25 is stretched over the end plug 31 of the cap 27. A retaining ring 53 fits over the end plug 31 and the marginal end of the reservoir 25, holding the reservoir in place on the end plug 31. The retaining ring 53 forms an interference fit with the marginal end of the reservoir 25 that is stretched over the end plug 31. The retaining ring 53 is then bonded to the cap 27, for example by epoxy cement, to permanently fix the retaining ring to the cap, thereby fixing the reservoir 25 to the cap 27. An annular groove 33 is also provided adjacent the intersection of the end plug 31 and the body portion 30 of the cap 27. The groove 33 provides additional clearance between the retaining ring and the cap 27 so that the open end of the reservoir 25 can be folded over to better seal the reservoir against the cap, as shown in FIG. 2. The outer shell 22 fits over the reservoir 25, the retaining ring 53, and the body 30 of the cap, and abuts the flange 29. The outer shell 22 is then bonded to the outer surface of the retaining ring 53 and the body 30 of the cap 27, for example by epoxy cement.

Figure 6:
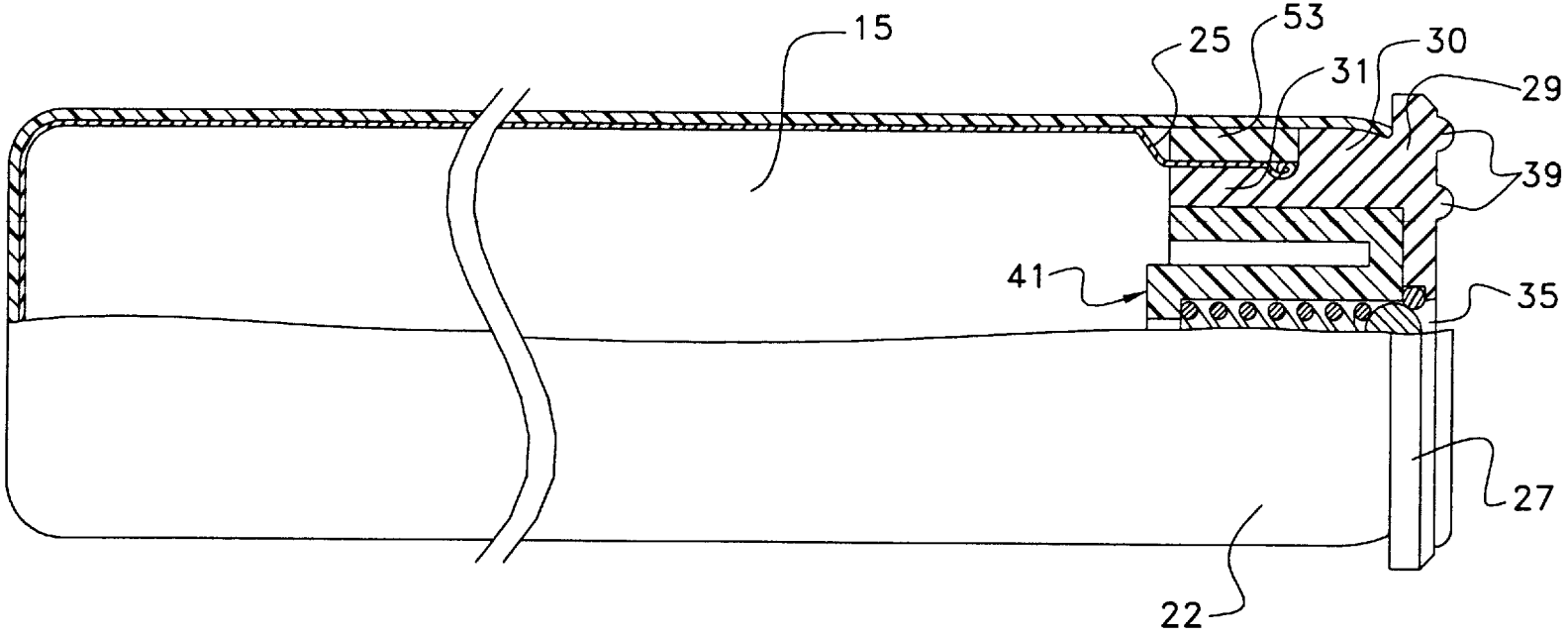
FIG. 6 is an enlarged elevational view of the replaceable cartridge used with the device illustrated in FIG. 1.

The cleaning fluid 15 discharges from the cartridge 20 through an opening 35 in the end of the cap 27. The flow of fluid 15 through the opening 35 is controlled by a check valve 41 which has a ball check 49 that seals against an O-ring 51. The check valve 41 is fixed within a cavity in the cap 27. The check valve 41 has an internal cylindrical chamber 45 aligned with the opening 35 in the cap 27. An inlet port 42 in the body of check valve allows fluid to flow from the reservoir 25 into the check valve chamber 45. A spring 47 and a check ball 49 in the check valve chamber 45 operate to prevent the flow of fluid through the cap opening 35. In FIG. 6, the check valve 41 is shown in the closed position. The spring 47 is biased against the check ball 49, forcing the check ball to seat against the O-ring 51, thereby sealing the cap opening 35. In FIG. 2, the check valve 41 is shown in the open position. A stem 65 displaces the check ball 49 from contact with the O-ring 51, so that fluid flows around the check ball and through the stem.

Figure 3:
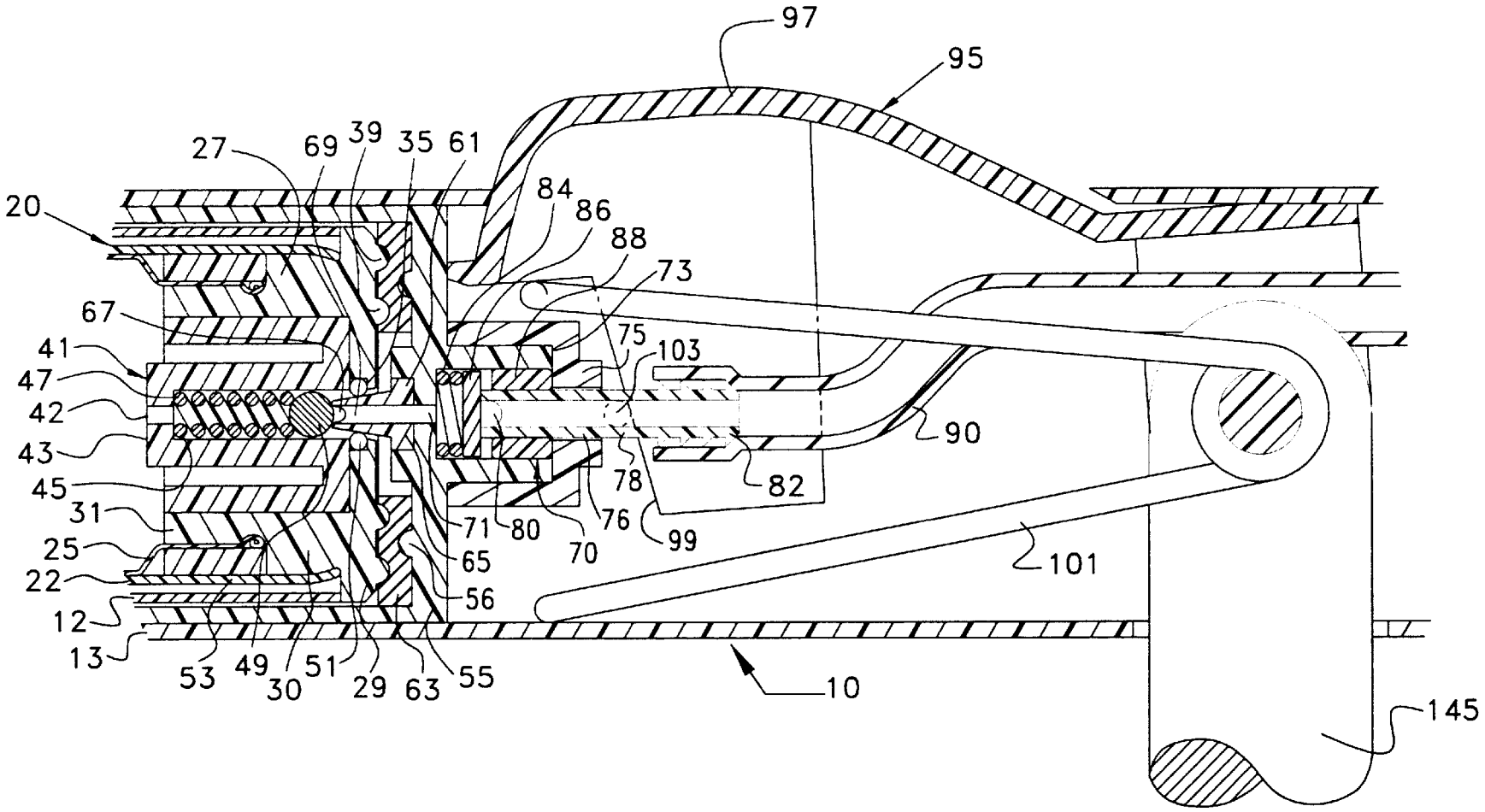
FIG. 3 is an enlarged fragmentary longitudinal sectional view of the portion of the device illustrated in FIG. 1 bounded by circle A, illustrating the control valve in the open position.

The connection of the cartridge 20 is shown in FIGS. 2–3. The upper half of the handle 12 is tubular, forming a sleeve with an open end for receiving the cartridge 20. The open end of the upper handle 12 abuts the flange 29 of the cap 27, so that when the upper handle 12 is assembled together with the lower handle 13, the upper handle forces the cartridge into a cartridge socket 55.

The cartridge socket 55 is a plastic liner inserted into the lower handle 13 and is generally cylindrical having an outside diameter similar to the inside diameter of the lower handle 13. One end of the cartridge socket 55 is closed, forming a base of the socket within the lower handle 13. The opposite end of the cartridge socket 55 extends out of the open end of the lower handle 13 and flares out forming a collar 57. The collar 57 has an internally-threaded portion 59 that cooperates with external threads 17 on the upper handle 12, to connect the upper handle with the lower handle.

When the device 10 is assembled so that the cartridge 20 is in the cartridge socket 55, the cartridge check valve 41 registers with a stem or nipple 65 that is fixed in the base of the cartridge socket. As shown in FIGS. 2–3, the stem or nipple 65 projects through the cap opening 35 and displaces the check valve ball 49. The stem 65 is frustoconical so that the tapered outer surface of the stem seals against the O-ring 51 of the cap 27 to prevent fluid from leaking out of the cartridge around the stem. A rubber washer 63 in the base of the cartridge socket 55 also provides a seal between the cartridge and the cartridge socket to prevent fluid from leaking from the cartridge around the stem. To provide a tighter seal with the rubber washer 63, the cartridge cap 27 has a pair of concentric annular half-round projections or ribs that protrude from the cap and deform the rubber washer 63 when the cartridge is seated in the cartridge socket 55. Similarly, the cartridge socket 55 has an annular half-round projection or rib that protrudes from the base of the socket and deforms the washer 63 when the cartridge 20 is registered in the cartridge socket.

A conduit 69 extends through the stem 65 and aligns with an aperture 71 in the bottom of the cartridge socket 55. A plurality of ports 67 are spaced about the tip of the stem 65. The ports 67 allow cleaning fluid to flow from the chamber of the check valve chamber 45 through the stem 65 and into the valve chamber 73 of the control valve 70. The valve chamber 73 is cylindrical, formed by walls that are integral with the cartridge socket 55, projecting away from the base of the cartridge socket. The end of the valve chamber 73 is enclosed by a valve cap 75.

In FIG. 2, the control valve 70 is shown in the closed position. The control valve 70 comprises a valve cylinder 73, a valve element 78, a gland 88 surrounding the valve element, a pusher disc 86, and a spring 84. The valve element 78 extends through an opening 76 in the valve cap 75. The valve element 78 is a generally cylindrical hollow tube. The end of the valve element 78 that extends into the valve chamber 73 has a plurality of inlet ports 80. The spring 84 is biased against the pusher disc 86, which in turn pushes the valve element 78 towards the gland 88 so that the in the closed position, the gland seals the ports 80 of the valve element. The distal end of the valve element 78 projects outside of the valve chamber and forms a barbed connector. The barbed connector connects the valve element 78 to a flexible vinyl tube 90.

In FIG. 3, the control valve is shown in the open position. In the open position, the valve element 78 is displaced rearwardly (from right to left from the perspective of FIGS. 2–3) against the pusher disc 86 and the spring 84. When the valve element 78 is displaced into the open position, the ports 80 of the valve element project beyond the gland 88 so that the ports are not sealed by the gland. Fluid in the valve chamber 73 flows around the pusher disc 86 and through the ports 80. The fluid then flows through the valve element 78 into the tube 90. In this way, when the cartridge 20.is seated in the cartridge socket 55 against the stem 65, the control valve 70 operates to control the flow of cleaning fluid from the reservoir 25 to the flexible tube 90, which is connected to a spray head 110.

Figure 4:
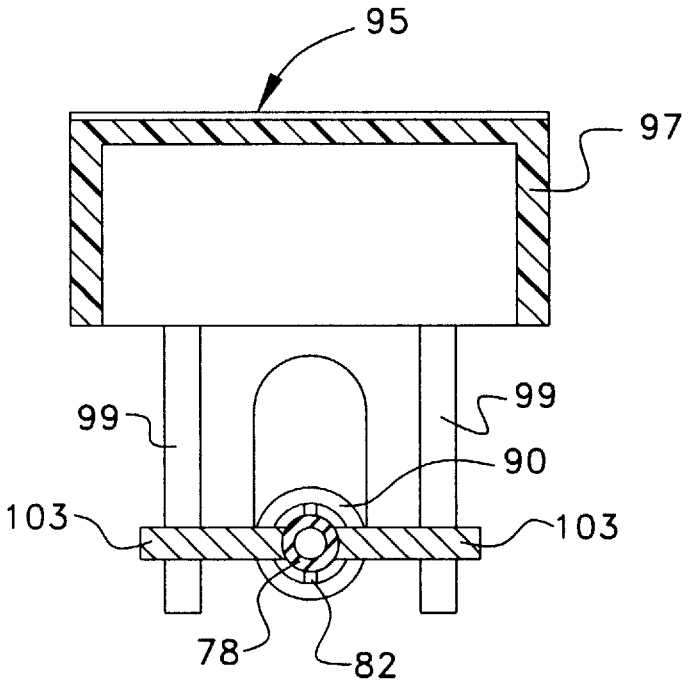
FIG. 4 is a cross-sectional view of the cleaning device shown in FIG. 2, taken along line 4—4, illustrating the actuator.

An actuator 95 operates to displace the control valve 70 between the open and closed positions. The actuator is actuated by depressing a button 97. Depressing the button 97 causes a pair of wedges 99 to displace the valve element 78. The wedges 99 are integral with the button 97 and are parallel and spaced-apart, straddling the valve element 78 and the tube 90. The wedges 99 confront a pair of studs 103 that project from the external surface of the valve element 78. In FIG. 4, the interaction between the studs 103 and the wedges 99 is shown, with details, such as the wringing lever eliminated for clarity. The studs 103 project from opposing sides of the external surface of the valve element 78. Each stud 103 confronts one of the two wedges that straddle the valve element 78.

As illustrated in FIGS. 2–4, when the button 97 is depressed downwardly, the tapered surface of the wedges 99 operates against the studs 103 to displace the valve element 78 transverse the wedges. In this way, the downward displacement of the wedges 99 causes longitudinal displacement of the valve element 78 within the valve chamber 73 so that the control valve is moved to the open position. A torsional spring 101 biases the button 97 upwardly, so that when the operator releases downward pressure on the button, the button returns to the upper or closed position. The spring 84 in the control valve chamber then forces the valve element 78 forward into the gland 88, so that the control valve 70 is in the closed position.

As detailed above, the control valve 70 incorporates a longitudinally displaceable sliding valve element 78. Alternatively, it may be desirable to utilize a control valve that incorporates a transversely displaceable sliding valve element. Such a transversely displaceable sliding valve element operates to control the flow of fluid by aligning or misaligning a port with the flow of fluid in response to actuation of the actuator 95. More specifically, in the closed position, the valve element seals the fluid path, blocking the flow of fluid 15 from the cartridge 20. By depressing the actuator button 97, the valve element is vertically displaced transverse the fluid path so that a port in the valve element aligns with the fluid path. By aligning the port with the fluid path, fluid is able to flow from the cartridge 20 through the control valve 70.

From the control valve 70, the cleaning fluid 15 flows through the tube 90 to a spray head 110 connected to the distal end of the tube. The spray head 110 is mounted to the external surface of the mop head 135 to direct the cleaning fluid onto the surface to be cleaned 5.

Figure 5:
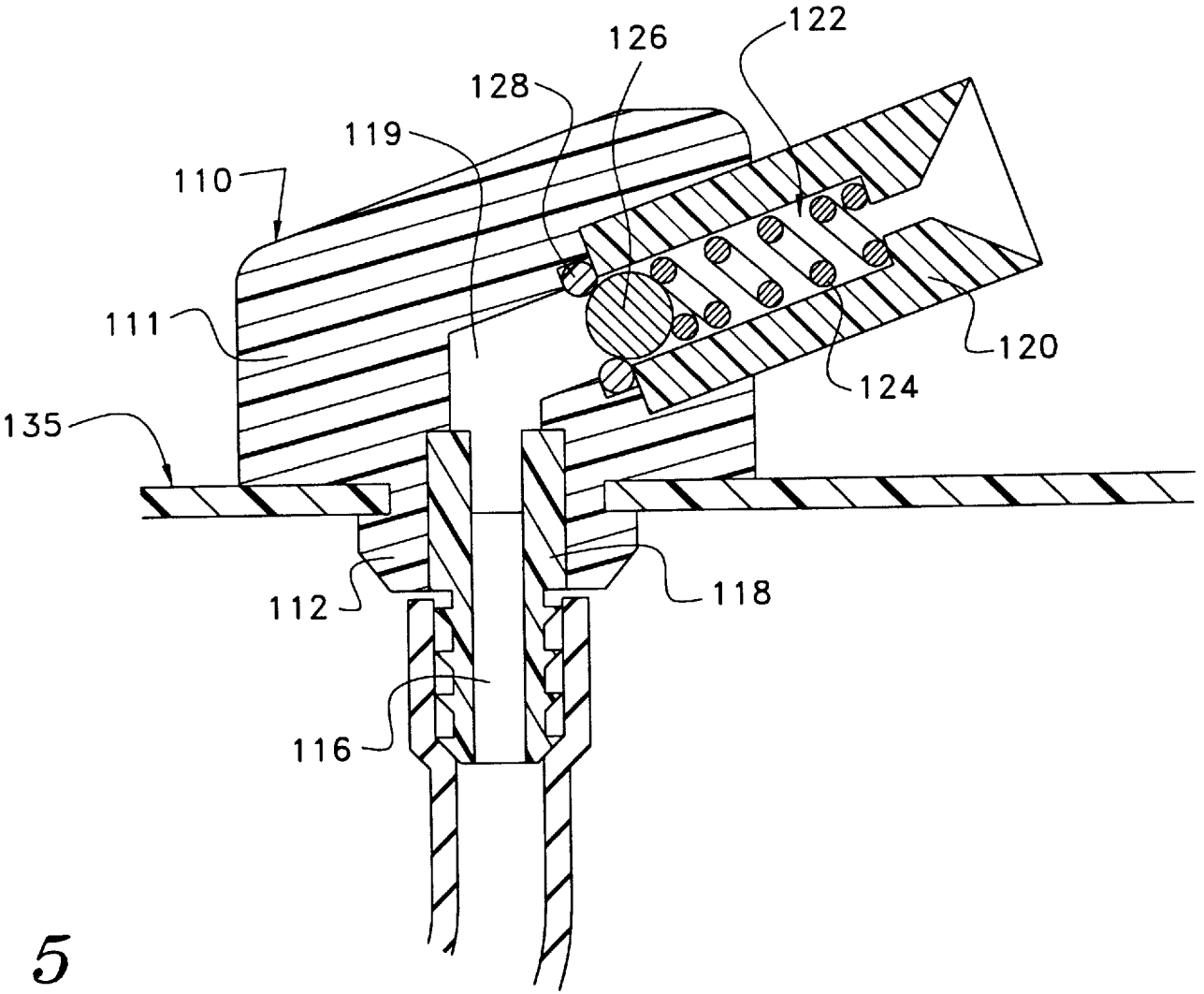
FIG. 5 is an enlarged fragmentary longitudinal sectional view of the portion of the cleaning device encircled at B, illustrating the spray head.

The spray head 110 is best seen in FIG. 5. The spray head comprises a base 111 that is mounted flush against the mop head 135. Fluid enters the spray head 110 through an inlet passage 116 that extends through a barbed connector 118. The barbed connector 118 is connected to the tube 90, which as detailed above, is connected to the control valve 70. The fluid is discharged from the spray head 110 through a nozzle 120. A conduit 119 through the base 111 connects the inlet passage 116 with the nozzle 120.

The spray head 110 is mounted to the mop head 135 by a mushroom-shaped connector 112 integrally formed with the base 111. The mushroom-shaped connector 112 passes through a hole in the mop head 135. The flared head of the mushroom-shaped connector seats against the internal surface of the mop head, fixing the spray head 110 flush against the external surface of the mop head.

The cleaning fluid exits from the spray head 110 through the nozzle 120. A check valve 122 controls the flow of fluid through the spray nozzle 120. The check valve 122 is a ball check valve having a check ball 126 and a spring 124. The spring 124 is biased against the check ball 126, so that in the closed position, the check ball seats against an O-ring 128, thereby preventing fluid from flowing through the nozzle 120. In the open position, the check ball 126 is displaced out of registry with the O-ring 128, so that fluid can flow around the check ball and discharge through the nozzle 120. The bias of the spring 124 is great enough to overcome the head pressure of the fluid remaining in the tube 90, caused by gravity, when the control valve 70 is in the closed position. The bias of the spring is also low enough to allow the check ball 126 to be displaced into the open position by the pressure of the cleaning fluid when the control valve 70 is in the open position.

The operation of the device 10 will now be described. The replaceable cartridge 20 is filled with cleaning fluid 15. Prior to being filled, the elastic reservoir 25 remains in its relaxed, contracted state. To fill the cartridge 20, the check ball 49 of the check valve 41 that seals the opening 35 of the cartridge is displaced, and the reservoir 25 is filled with cleaning fluid 15. As the reservoir 25 is filled, the reservoir elastically expands. As the reservoir expands, the stored elastic potential energy in the elastic reservoir 25 increases. The elastic tendency of the filled reservoir to return to its contracted state acts on the fluid 15 within the reservoir so that the fluid is maintained within the reservoir under positive pressure.

As described above, the device 10 incorporates three different valves that control the flow of the cleaning fluid 15. The cartridge check valve 41 prevents cleaning fluid 15 from leaking out the cartridge opening 35 when the cartridge is not assembled with the device. When the cartridge is assembled with the device 10, the stem 65 displaces the check valve 41 so that fluid flows from the cartridge 20 into the valve chamber 73 of the control valve 70. In this way, when the cartridge is assembled with the device, the control valve 70 controls the flow of cleaning fluid. When the actuator button 97 of the actuator 95 is depressed, the control valve 70 is displaced to the open position. In the open position, fluid flows from the cartridge 20 through the control valve into the tube 90 and then flows to the spray head 110. The cleaning fluid exiting the cartridge exerts sufficient force on the check ball 126 of the check valve 122 in the spray head 110 to displace the check ball so that the cleaning fluid discharges through the nozzle 120 onto the cleaning surface 5, adjacent the mop head 135.

Once the actuator button 97 is released, the control valve returns to the closed position, preventing the flow of cleaning fluid from the cartridge to the tube 90. When the control valve 70 is in the closed position, the check valve 122 in the spray head 110 operates to prevent the fluid remaining in the tube 90 from leaking or bleeding out of the spray head 110.

The cartridge may be recharged when the cleaning fluid is exhausted. After the elastic energy is exhausted, the cartridge 20 may be removed from the socket 55, and the check valve 41 prevents leakage. To recharge the cartridge, cleaning fluid is injected through the valve 41 under sufficient pressure to elastically expand the reservoir 25 and restores the elastic energy expended in previous use. The elastic energy is stored by the elastic reservoir 25 until it is exhausted in subsequent operations.

Some of the many novel features and advantages of the present invention are now apparent in view of the foregoing description. For example, a cleaning device has been described which includes a replaceable and resealable cartridge that provides a supply of cleaning fluid. The cartridge incorporates an elastically-expandable reservoir so that the cleaning fluid within the reservoir is maintained under positive pressure while the reservoir is expanded. In this manner, when the fluid in the cartridge is released, the stored elastic potential energy in the expanded reservoir provides the energy necessary to discharge the cleaning fluid from the device onto the surface being cleaned. Thus, the need to use a pressure vessel and compressed gas to discharge the cleaning fluid is eliminated. Similarly, the need to pressurize the fluid in the reservoir by use of a hand pump is eliminated.

While particular embodiments of the present invention have been herein illustrated and described, it is not intended to limit the invention to such disclosure, but changes and modifications may be made therein and thereto within the scope of the following claims.

We claim:

1. A cleaning device comprising:

an elongated handle;

a cleaning head connected to said handle;

a discharge orifice spaced apart from said cleaning head,;

a wringing mechanism straddling the cleaning head, operable to wring the cleaning head;

a reservoir for storing fluid having an outlet in fluid communication with said discharge orifice; and a fluid controller in the path of fluid communication between said reservoir outlet and said discharge orifice for controlling the flow of fluid from said reservoir to said discharge orifice.

2. The cleaning device of claim 1 wherein said fluid controller comprises a sliding valve in said handle operable between an open and closed position.

3. The device of claim 2 wherein said fluid controller further comprises an actuator operable externally of said handle to operate said sliding valve between the open and closed positions.

4. The cleaning device of claim 1 further comprising a cartridge, said cartridge comprising an outer shell enclosing said reservoir.

5. The cleaning device of claim 4 wherein said handle is hollow, forming a chamber receiving said cartridge.

6. The cleaning device of claim 4 wherein said cartridge further comprises a valve in said reservoir outlet for controlling the flow of fluid from said reservoir to said fluid controller.

7. The cleaning device of claim 6 wherein said path of fluid communication includes a removable connector connecting said cartridge valve with said fluid controller.

8. The cleaning device of claim 7 wherein said cartridge valve includes a resealable seal preventing fluid from discharging from said cartridge when said cartridge is disconnected from said fluid controller.

9. A cleaning device comprising:

a handle;

a cleaning head connected to said handle;

a discharge orifice spaced apart from said cleaning head;

a wringing mechanism connected with said handle, operable to wring the cleaning head;

a fluid supply cartridge comprising:
an outer shell; and a reservoir for storing fluid within said outer shell, said reservoir having an outlet in fluid communication with said discharge orifice; and a fluid controller in the path of fluid communication between said reservoir outlet and said discharge orifice for controlling the flow of fluid from said reservoir to said discharge orifice.

10. The cleaning device of claim 9 wherein said handle is hollow, forming a chamber receiving said cartridge.

11. The cleaning device of claim 9 wherein said cartridge further comprises a valve in said reservoir outlet for controlling the flow of fluid from said reservoir to said fluid controller.

12. A cleaning device of claim 9 wherein said fluid controller comprises a sliding valve in said handle operable between an open and closed position.

13. The device of claim 12 further comprising an actuator operable to operate said sliding valve between the open and closed positions.

14. The cleaning device of claim 11 wherein said path of fluid communication includes a removable connector connecting said cartridge valve with said fluid controller.

15. The cleaning device of claim 14 wherein said cartridge valve includes a resealable seal preventing fluid from discharging from said cartridge when said cartridge is disconnected from said fluid controller.

* * * * *